US009611739B2

(12) United States Patent
Lundman

(10) Patent No.: US 9,611,739 B2
(45) Date of Patent: Apr. 4, 2017

(54) INFLATABLE TUNNEL SEAL

(76) Inventor: Philip L. Lundman, Fredonia, WI (US)

( * ) Notice: Subject to any disclaimer, the term of this patent is extended or adjusted under 35 U.S.C. 154(b) by 1640 days.

(21) Appl. No.: 12/789,682

(22) Filed: May 28, 2010

(65) Prior Publication Data

US 2011/0135395 A1 Jun. 9, 2011

Related U.S. Application Data

(60) Provisional application No. 61/182,795, filed on Jun. 1, 2009.

(51) Int. Cl.
*E21D 9/06* (2006.01)
*E21F 17/107* (2006.01)

(52) U.S. Cl.
CPC ..... *E21F 17/107* (2013.01)

(58) Field of Classification Search
CPC ..... E21F 17/107
USPC .... 405/147, 150.1, 184.2, 289, 303; 138/93, 138/97, 98
See application file for complete search history.

(56) References Cited

U.S. PATENT DOCUMENTS 3,960,193 A * 6/1976 Davis ..... 108/90
4,079,755 A * 3/1978 Van der Lans ..... 138/93
4,371,288 A * 2/1983 Borca et al. ..... 405/53
4,550,751 A * 11/1985 Shimamura et al. ..... 138/93
4,880,035 A * 11/1989 Vetter ..... 138/99
4,883,094 A * 11/1989 Vetter ..... 138/89
4,995,761 A * 2/1991 Barton ..... 405/184.1
5,353,842 A * 10/1994 Lundman ..... 138/93
5,469,920 A * 11/1995 Conti et al. ..... 169/48
5,520,484 A * 5/1996 Kamiyama et al. ..... 405/184.2
5,546,991 A * 8/1996 Mathison et al. ..... 138/93
5,643,386 A * 7/1997 Mathison et al. ..... 156/218
5,738,172 A * 4/1998 van Mook et al. ..... 166/344
5,846,025 A * 12/1998 Kamiyama et al. ..... 405/184.2
5,964,288 A * 10/1999 Leighton et al. ..... 166/207
6,463,801 B1 * 10/2002 Young et al. ..... 73/170.32
6,547,492 B1 * 4/2003 Degville ..... 405/289
6,612,340 B1 * 9/2003 Lause ..... 138/98
6,615,923 B1 * 9/2003 Lay, Jr. et al. ..... 166/368
6,679,293 B2 * 1/2004 Driver ..... 138/98
6,723,266 B1 * 4/2004 Lippiatt ..... 264/173.17
6,913,301 B2 * 7/2005 Gotz et al. ..... 294/74
6,959,734 B2 * 11/2005 Lundman ..... 138/93
7,056,179 B2 * 6/2006 Courtney ..... 441/90
7,063,582 B2 * 6/2006 Boujon ..... 441/38
7,112,254 B1 * 9/2006 Driver ..... 156/285
7,152,614 B2 * 12/2006 Kalnay ..... 135/128
7,216,674 B2 * 5/2007 Manners ..... 138/98
7,357,146 B2 * 4/2008 Beaty ..... 137/172
7,708,033 B2 * 5/2010 Tanaka et al. ..... 138/98
2004/0003855 A1 * 1/2004 Dees et al. ..... 138/93
2004/0031099 A1 * 2/2004 Mastandrea, Jr. ..... 5/482
2004/0112451 A1 * 6/2004 Lundman ..... 138/93
2004/0134551 A1 * 7/2004 Warren ..... 138/98
(Continued)

*Primary Examiner* — Amber Anderson
*Assistant Examiner* — Patrick Lambe
(74) *Attorney, Agent, or Firm* — Michael Best & Friedrich LLP

(57) ABSTRACT

A tunnel seal including a body, inflatable from a folded position to an inflated position, multiple positioning straps coupled to the body, an inflow port fluidly connected to the body, a pressure relief valve fluidly connected to the body, and a hot stab receptacle fluidly connected to the inflow port.

9 Claims, 8 Drawing Sheets

(56) References Cited

U.S. PATENT DOCUMENTS

| | | | | |
|---|---|---|---|---|
| 2004/0144439 | A1* | 7/2004 | Lundman | 138/93 |
| 2004/0258479 | A1* | 12/2004 | Manners | 405/184.2 |
| 2005/0268837 | A1* | 12/2005 | Mears | 114/263 |
| 2006/0188339 | A1* | 8/2006 | De Bruijn et al. | 405/150.1 |
| 2007/0031194 | A1* | 2/2007 | Driver et al. | 405/184.2 |
| 2007/0113339 | A1* | 5/2007 | Field et al. | 5/482 |
| 2007/0240827 | A1* | 10/2007 | Driver | 156/461 |
| 2008/0040938 | A1* | 2/2008 | Tedesco et al. | 33/2 R |
| 2008/0163951 | A1* | 7/2008 | Lundman | 138/93 |
| 2009/0080980 | A1* | 3/2009 | Cohen | 405/184.2 |
| 2010/0104376 | A1* | 4/2010 | Skarbovig | 405/232 |
| 2010/0122767 | A1* | 5/2010 | Taylor et al. | 156/294 |
| 2010/0135732 | A1* | 6/2010 | Skarbovig | 405/289 |
| 2010/0150659 | A1* | 6/2010 | Kamiyama et al. | 405/184.2 |
| 2010/0206417 | A1* | 8/2010 | Wolf et al. | 138/99 |
| 2010/0212766 | A1* | 8/2010 | Kiest, Jr. | 138/98 |
| 2011/0222970 | A1* | 9/2011 | Skarbovig | 405/289 |

* cited by examiner

INFLATABLE TUNNEL SEAL

BACKGROUND

The present invention relates to inflatable plugs and, more particularly, to inflatable tunnel seals and related methods.

SUMMARY

In one embodiment, the invention provides a tunnel seal including a body, inflatable from a folded position to an inflated position, multiple positioning straps coupled to the body, an inflow port fluidly connected to the body, a pressure relief valve fluidly connected to the body, and a hot stab receptacle fluidly connected to the inflow port.

In another embodiment, the invention provides a tunnel seal including a body, inflatable from a folded position to an inflated position. The body includes an inner bladder and an outer cover. The tunnel seal also includes multiple positioning straps coupled to the body, an inflow port fluidly connected to the inner bladder, a pressure relief valve fluidly connected to the inner bladder, and a hot stab receptacle fluidly connected to the inflow port.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting.

Figure 1:
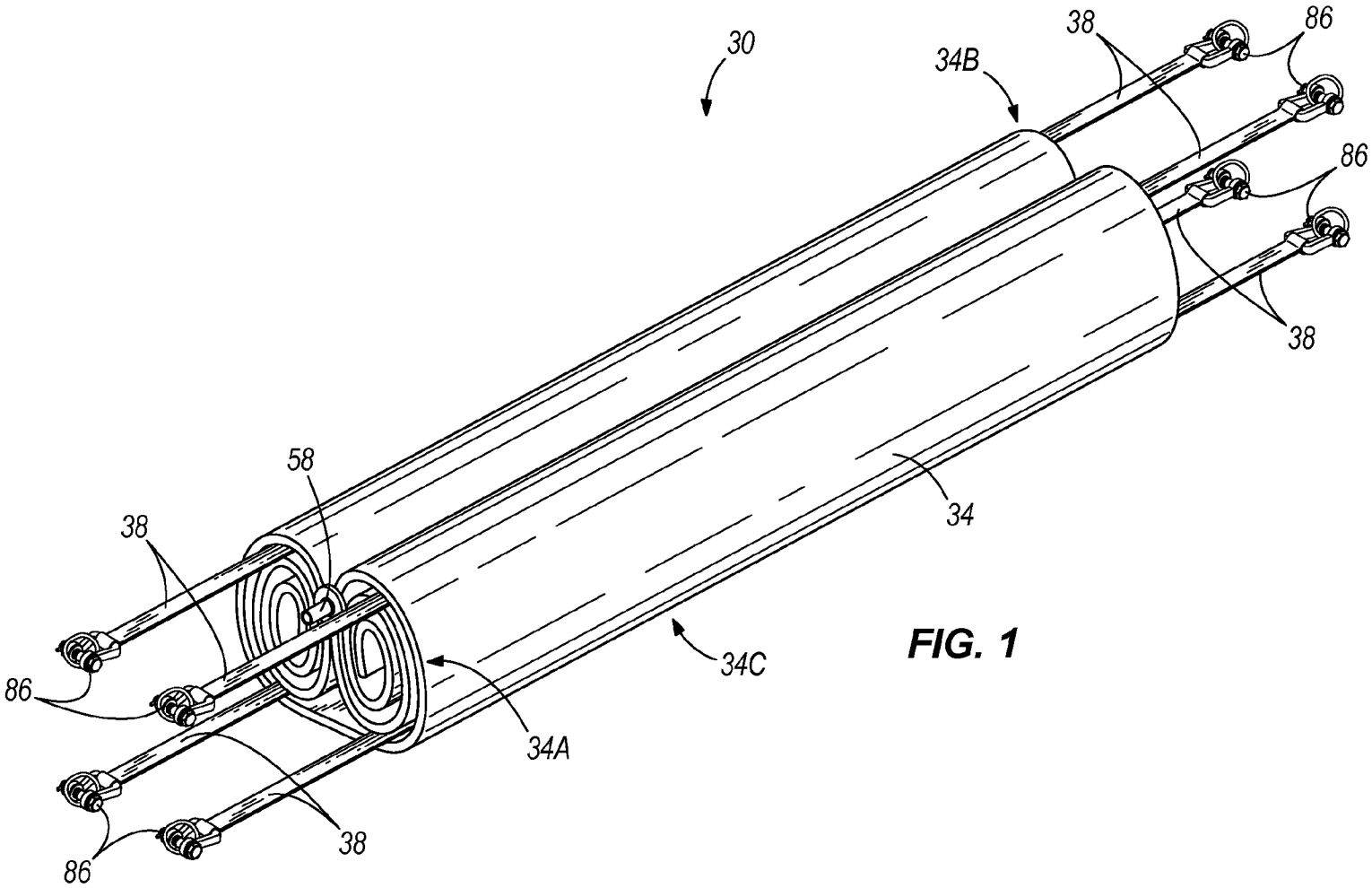
FIG. 1 is a perspective view of an inflatable tunnel seal.

FIG. 1 illustrates an inflatable tunnel seal 30 according to one embodiment of the invention. The tunnel seal 30 is a relatively large plug used to fill large tunnels, such as those found in a mine drift. The tunnel seal 30 may be filled with air, water, cement, grout, and/or other fluids or semi-fluids to inflate the seal 30. In the illustrated embodiment, the tunnel seal 30 is a generally cylindrical plug having an inflated diameter of 21 feet (6.4 meters) that will effectively fill a 17.72 feet (5.4 meters) high by 19.69 feet (6.0 meters) wide tunnel. The rounded shape of the tunnel seal 30 helps the seal 30 self-right if the seal 30 lands on a surface in a non-upright position.

Figure 2:
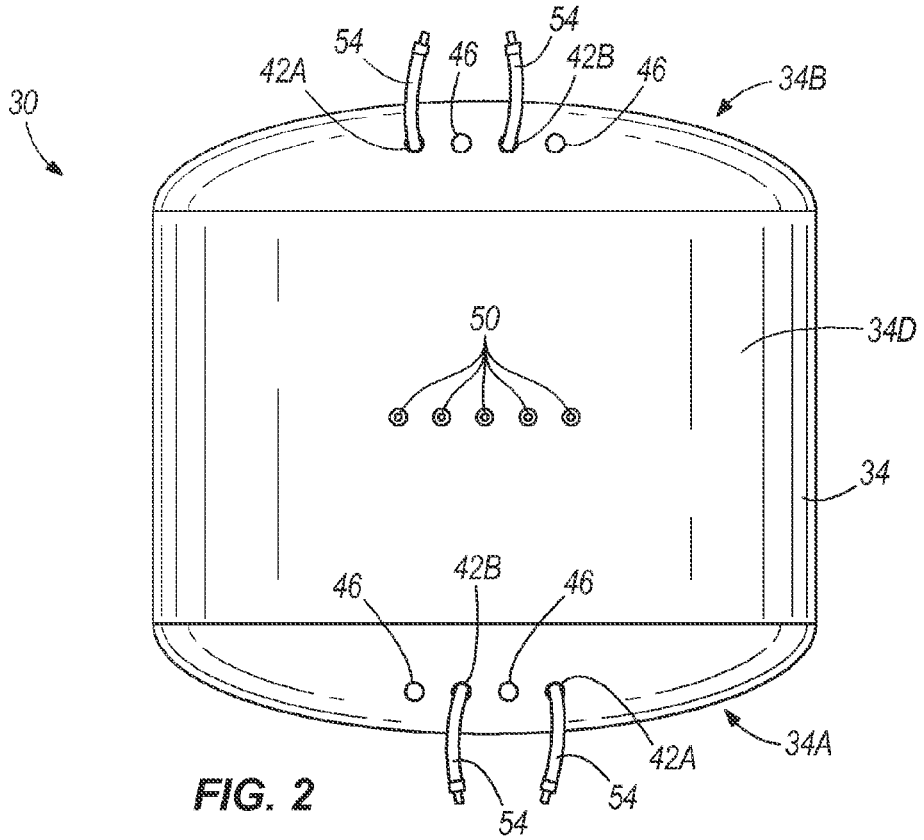
FIG. 2 is a top view of the inflatable tunnel seal of FIG. 1.
Figure 3:
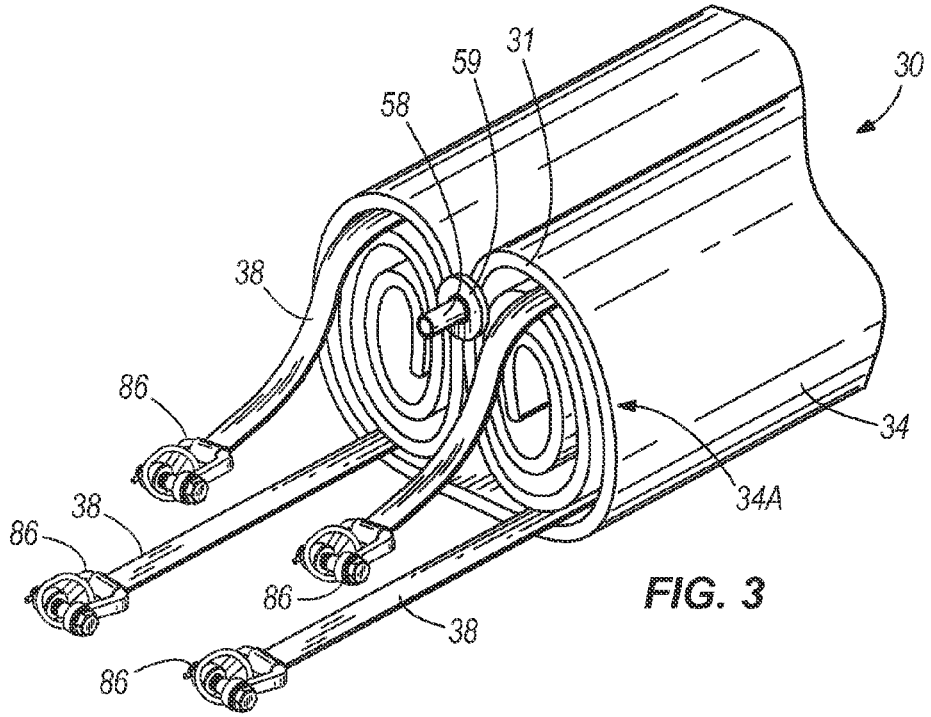
FIG. 3 is a perspective view of an end of the inflatable tunnel seal of FIG. 1.
Figure 15:
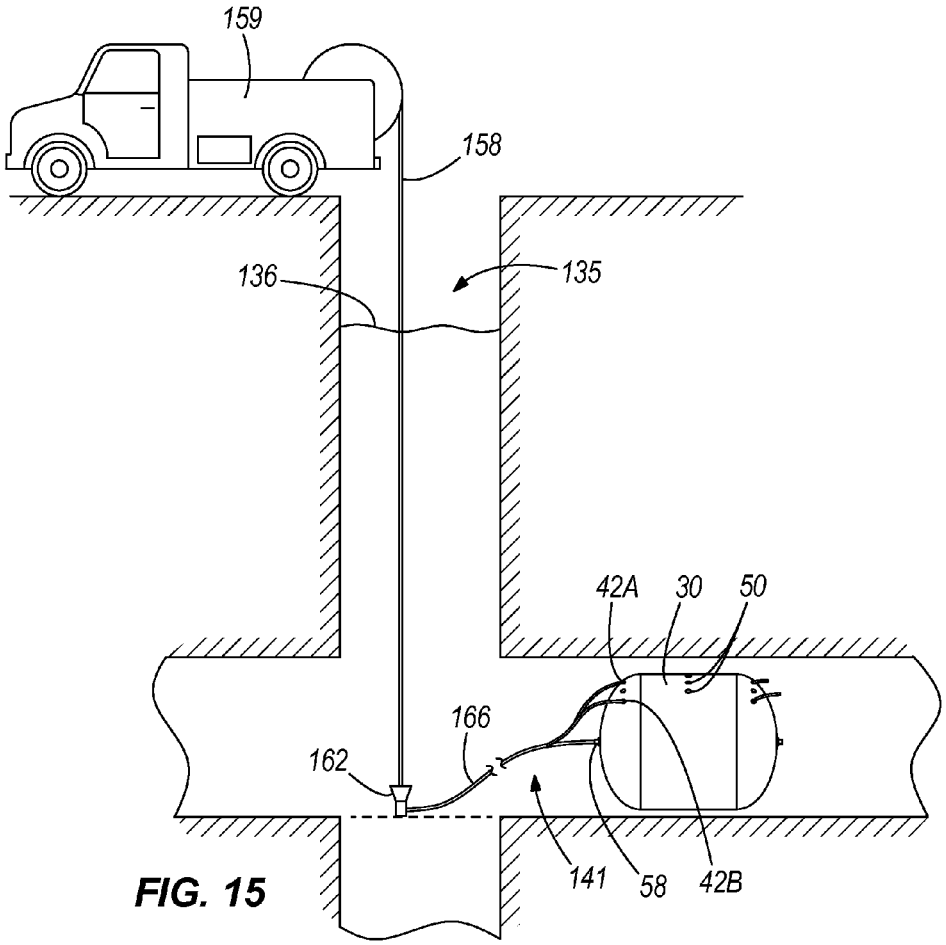
FIG. 15 schematically illustrates the inflatable tunnel seal of FIG. 1 in an inflated position within the mine drift.

As shown in FIGS. 1-3, the tunnel seal 30 includes an inflatable body 34, a plurality of positioning straps 38, and a plurality of ports 42A, 42B, 46 coupled to the body 34. The ports 42A, 42B, and 46 are fluidly connected to the body 34 to allow a fluid to flow into or out of the body 34 through the ports 42A, 42B, and 46. The body 34 is inflatable from a folded position (FIG. 1) to an inflated position (FIG. 15). In the illustrated embodiment, the tunnel seal 30 includes four nylon positioning straps 38 that each extend past a first end 34A and past a second end 34B of the body 34. In addition, the illustrated tunnel seal 30 includes four ports 42A, 42B, 46 on each end of the body 34 and five ports 50 on an upper surface 34D of the body 34. Two of the end ports 42A, 42B on each end 34A, 34B are for inflow and two of the end ports 46 are pressure relief valves for outflow. On each end of the tunnel seal 30, one of the inflow end ports 42A is positioned near a top-center of the seal 30 and the other inflow end port 42B is positioned further down the seal 30 to facilitate inflation after the tunnel seal 30 is initially inflated. The top ports 50 are pressure relief valves. When the tunnel seal 30 is in the folded position (FIG. 1), inflation hoses 54 extending from the inflow end ports 42A, 42B are folded into the seal 30 such that the ports 42A, 42B are not visible. In the folded position, the ports 42A, 42B are covered by a portion of the folded body 34. In the folded position, a hot stab receptacle 58 (FIG. 3) extends from each end 34A, 34B of the tunnel seal 30 to facilitate initial inflation of the tunnel seal 30. Each inflation hose 54 fluidly connects an inflow port 42A, 42B to a hot stab receptacle 58. The hot stab receptacle 58 functions as a connector for a delivery hose that provides the fluid to be used to inflate the tunnel seal 30. A support disc 59 is attached to each hot stab receptacle 58. When the tunnel seal 30 is in the folded position, each support disc 59 engages an edge 31 of the folded tunnel seal 30 to prevent the hot stab receptacle 58 from being pushed into the interior of the folded tunnel seal 30 when the delivery hose is connected to the hot stab receptacle 58.

Figure 4:
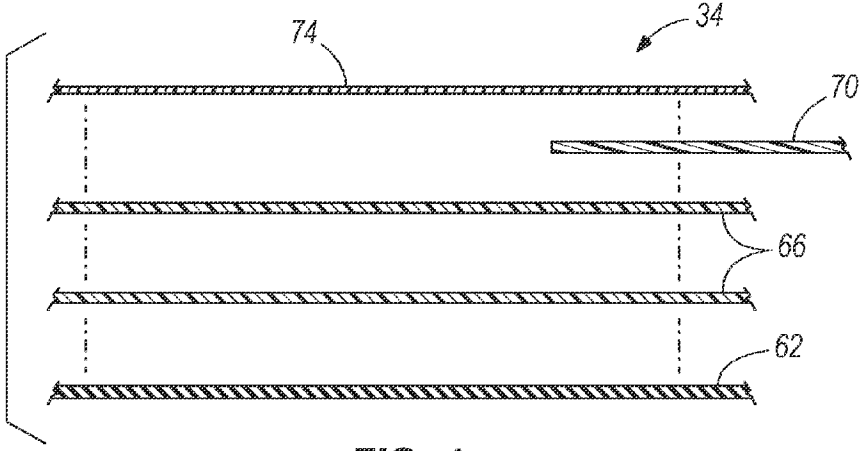
FIG. 4 schematically illustrates an inflatable body of the inflatable tunnel seal of FIG. 1.

Referring to FIG. 4, the illustrated inflatable body 34 is composed of an inner bladder 62, two intermediate plies 66, a plurality of straps 70, and an outer cover 74. The inner bladder 62 may be, for example, a polyurethane film bladder. The intermediate plies 66 may be, for example, polyurethane-coated ballistic nylon plies. The straps 70 may be, for example, nylon straps. The outer cover 74 may be, for example, a Kevlar® outer cover. The outer cover 74 is made oversized so as to not carry the inflation load of the bladder 62. The intermediate plies 66 are tied together using loops and ties spaced around end diameters of the body 34. The ports 42A, 42B, 46, and 50 are fluidly connected to the inner bladder 62.

Figure 5:
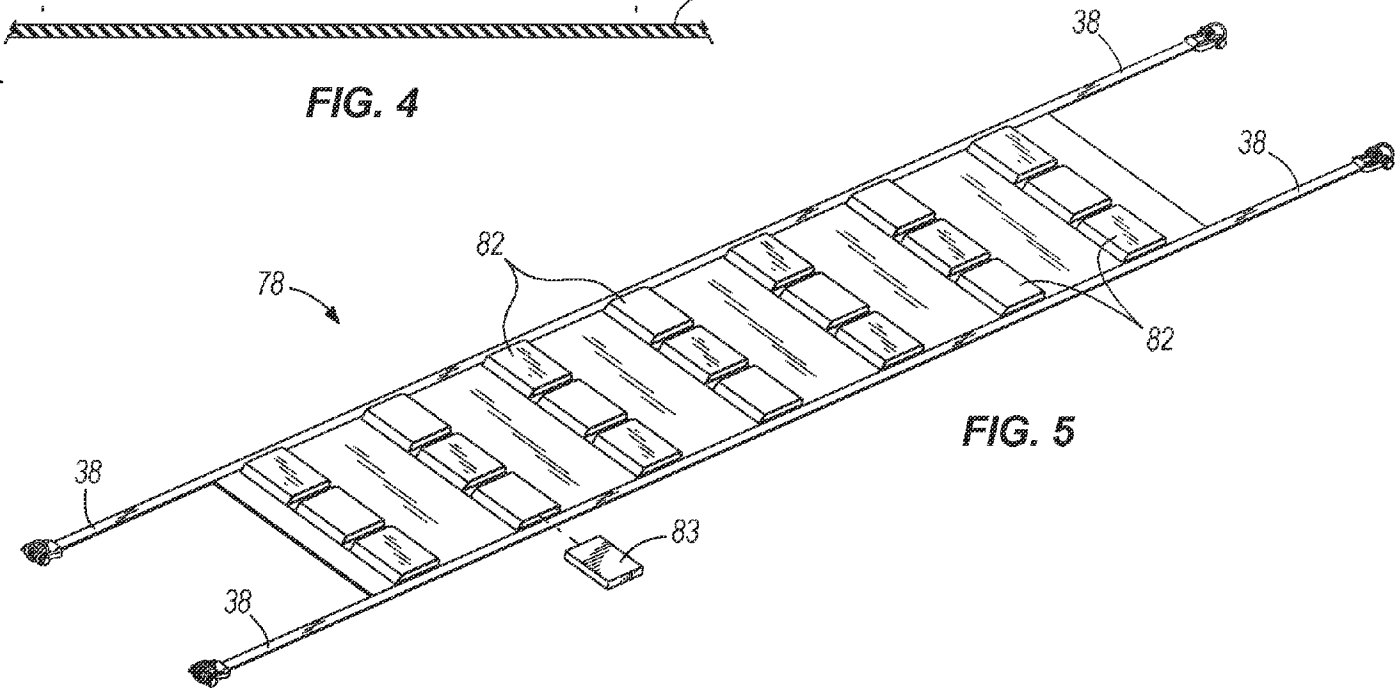
FIG. 5 is a perspective view of a weighted pad for use with the inflatable tunnel seal of FIG. 1.

FIG. 5 illustrates a weighted pad 78 for use with the inflatable tunnel seal 30. The weighted pad 78 is attached to a lower surface 34C of the body 34 to help orient the tunnel seal 30 within a mine drift, to maintain the position of the seal 30 within the drift when inflated, and to inhibit the seal 30 from floating. The weighted pad 78 includes a plurality of pockets 82, each of which encloses a weight 83, for example, a 25 pound (11.34 kilogram) weight. In the illustrated embodiment, the weights 83 are removable from the pockets 82, but may alternatively be permanently fixed within the pockets 82. The weighted pad 78 also functions as a sled to help slide the inflatable tunnel seal 30 along a surface when the seal 30 is folded or bundled for transport. In the illustrated embodiment, the positioning straps 38 are coupled (e.g., sewn) directly to the weighted pad 78. In some embodiments, the weighted pad 78 may have a width of about 48 inches (1.22 meters) to fit between guide cables of a mine shaft.

Figure 6:
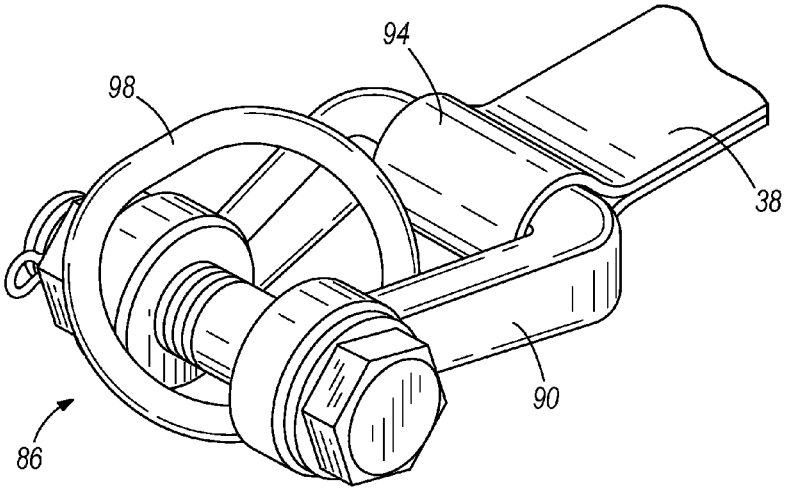
FIG. 6 is a perspective view of a shackle arrangement for use with the inflatable tunnel seal of FIG. 1.

FIG. 6 illustrates a shackle arrangement 86 connected to one of the positioning straps 38 of the inflatable tunnel seal 30. Although only one shackle arrangement 86 is shown, it should be readily apparent that a shackle arrangement 86 may be coupled to each of the positioning straps 38 extending from the tunnel seal 30. The shackle arrangement 86 is used to hoist and drag the inflatable tunnel seal 30. The illustrated shackle arrangement 86 includes a web shackle 90 that is inserted through a loop 94 sewn into the positioning strap 38 and a sling link 98 placed within the web shackle 90. The web shackle 90 is primarily used for hoisting the tunnel seal 30, and the sling link 98 is primarily used for connecting to a cable for dragging the tunnel seal 30, but the two components may be used for opposite purposes. Connecting the sling link 98 to the web shackle 90 ensures that at least one of the components will not lie flat on the floor, thereby facilitating connection of a cable to the shackle arrangement 86.

Figure 7:
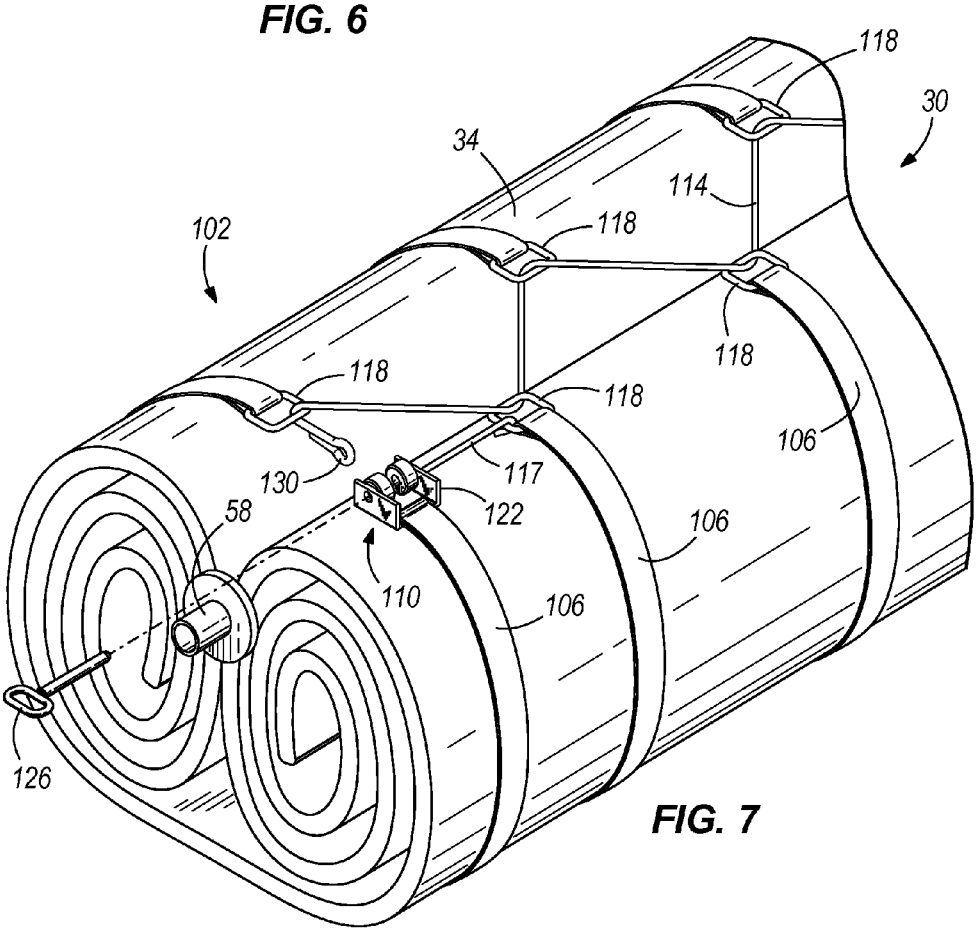
FIG. 7 is a perspective view of the inflatable tunnel seal of FIG. 1 including a strap assembly and a release mechanism.
Figure 8:
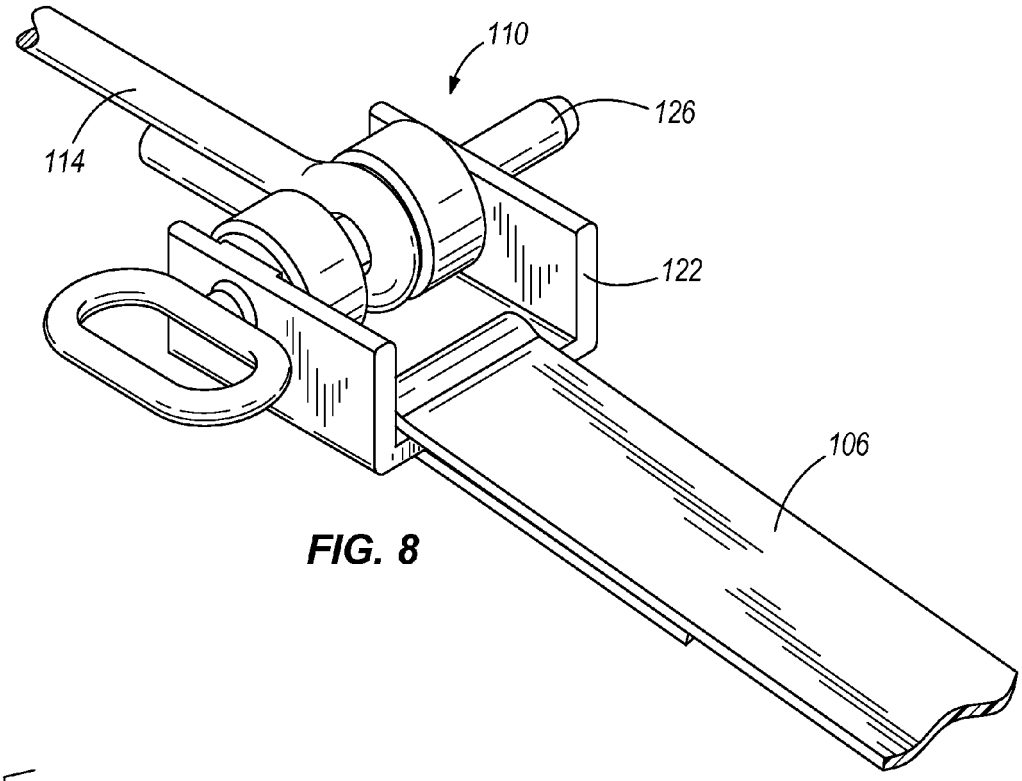
FIG. 8 is a perspective view of the release mechanism of FIG. 7.
Figure 9:
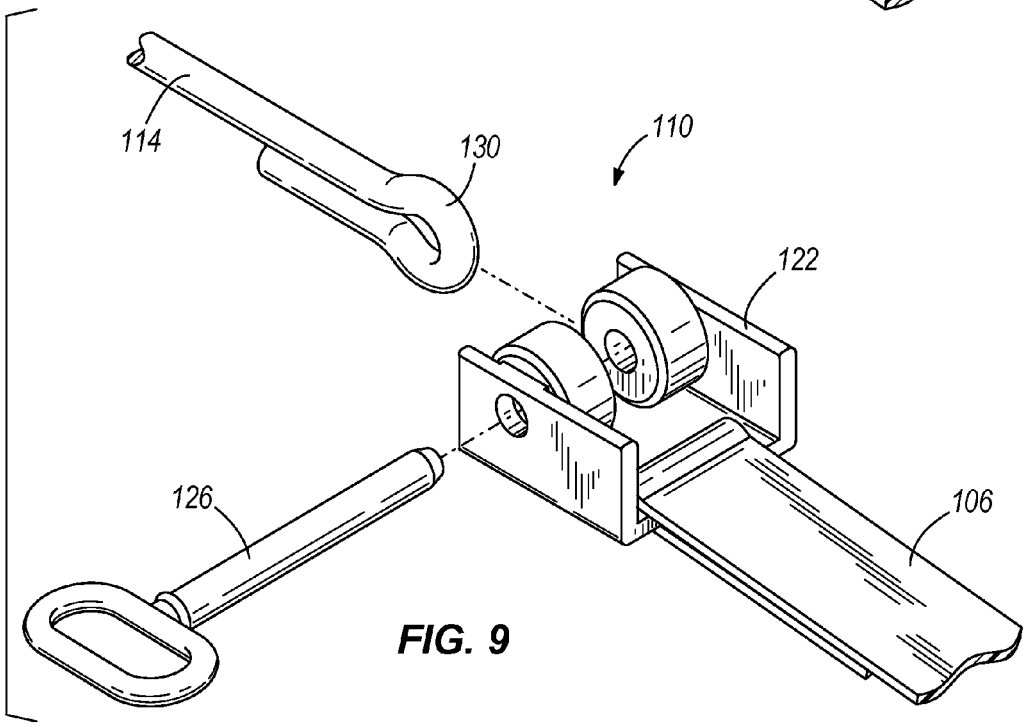
FIG. 9 is an exploded view of the release mechanism of FIG. 7.

FIG. 7 illustrates a strap assembly 102 for use with the inflatable tunnel seal 30. The strap assembly 102 includes a plurality of cinch straps 106 that wrap around the tunnel seal 30 to maintain the tunnel seal 30 in a folded or bundled position. A cord 114 extends through rings 118 coupled to each cinch strap 106. As shown in FIGS. 8 and 9, a release mechanism 110 is coupled to the strap assembly 102 to facilitate quickly unstrapping the tunnel seal 30. The release mechanism 110 includes a bracket 122 coupled to one of the cinch straps 106 and a pin 126 that extends through a loop 130 in the cord 114 and the bracket 122. As shown in FIG. 7, pulling the pin 126 out of the bracket 122 removes the pin 126 from the loop 130 such that the cord 114 may unthread from the rings 118. A restraint 117 connects the bracket 122 to the closest ring 118 to prevent the bracket 122 from moving when the pin 126 is being removed. In the illustrated embodiment, the cord 114 is a rope. In some embodiments, a second bracket 122 is coupled to one of the cinch straps 106 and a second pin 126 extends through a second loop 130 in the cord 114 to secure the cord 114 to the second bracket 122. In this way, the strap assembly 102 can be unsecured from either end 34A, 34B of the tunnel seal 30.

Figure 10:
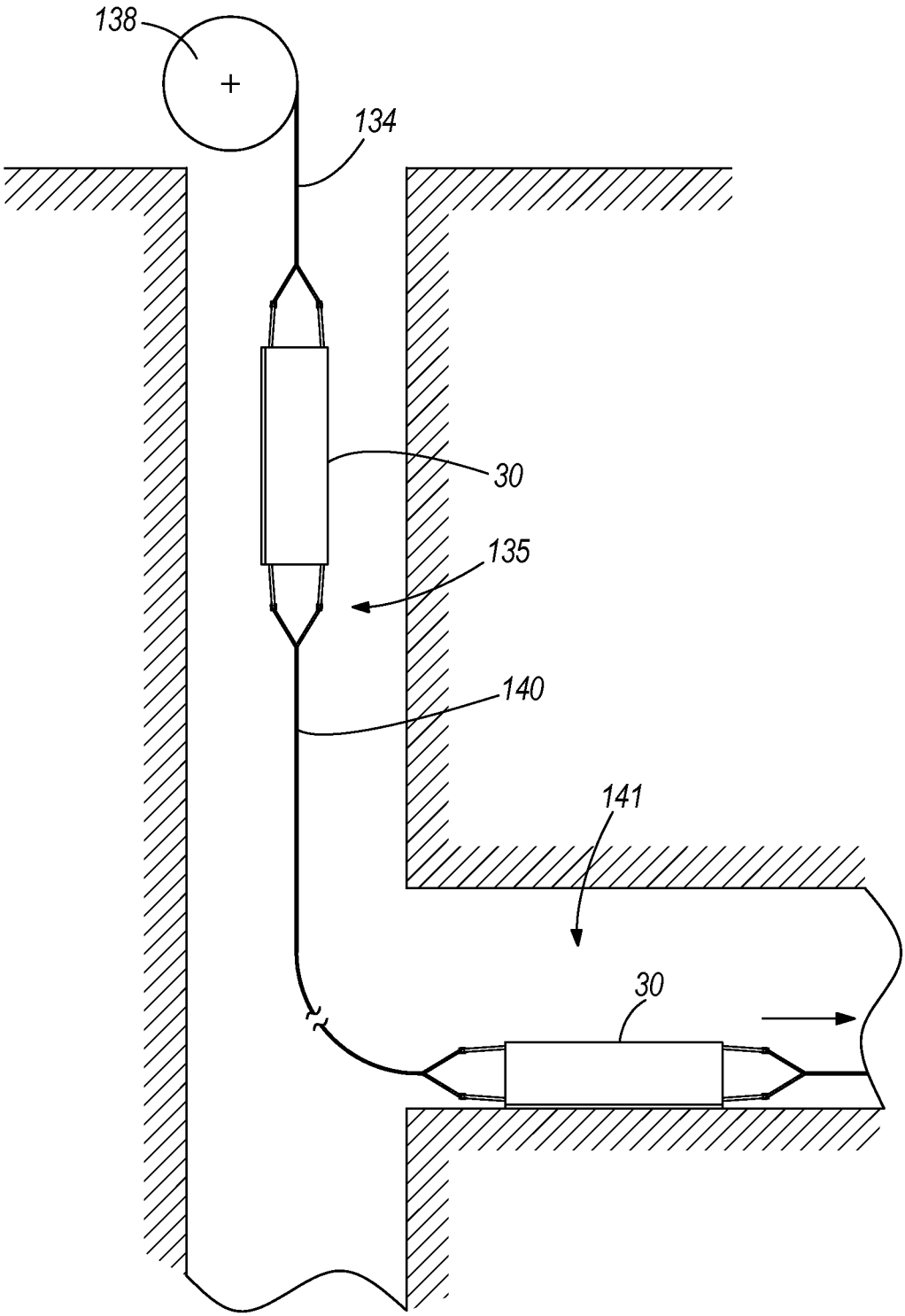
FIG. 10 schematically illustrates the inflatable tunnel seal of FIG. 1 being lowered into a mine drift.

FIG. 10 illustrates the inflatable tunnel seal 30 being lowered down a shaft 135 and into a tunnel 141 of a mine drift. A first cable 134 is connected between a hoist mechanism 138 and one end of the tunnel seal 30 to lower the tunnel seal 30 down the shaft 135. A second cable 140 is connected to an opposite end of the tunnel seal 30 to pull the tunnel seal 30 into and along the tunnel 141.

Figure 11:
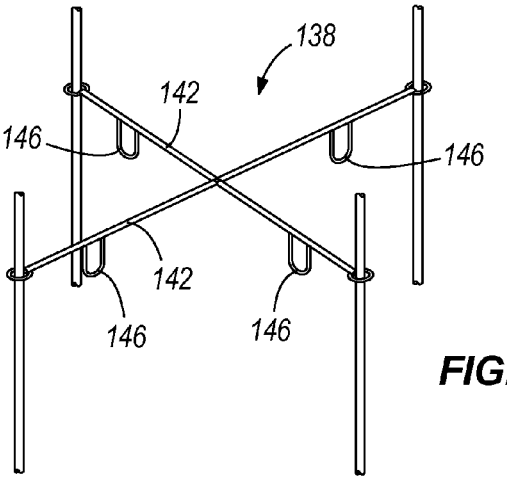
FIG. 11 is a perspective view of a hoist mechanism.
Figure 12:
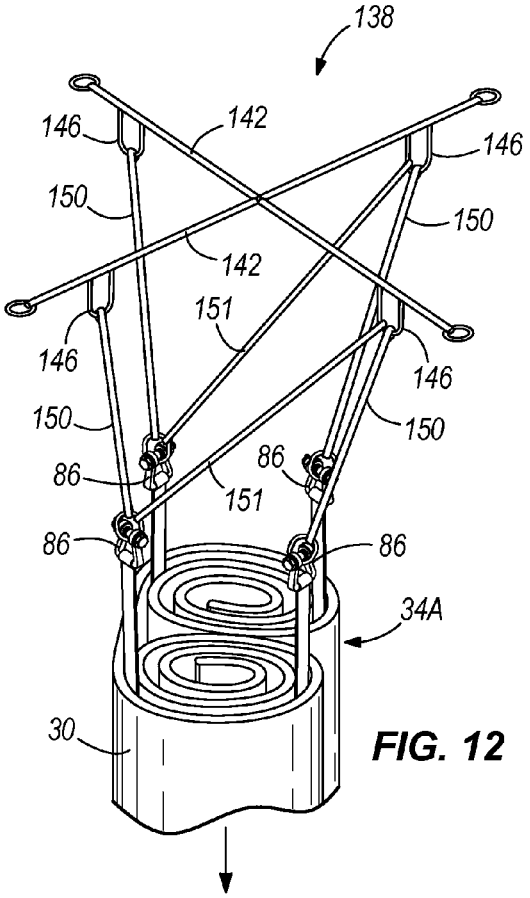
FIG. 12 is a perspective view of the hoist mechanism of FIG. 11 connected to the inflatable tunnel seal of FIG. 1.
Figure 13:
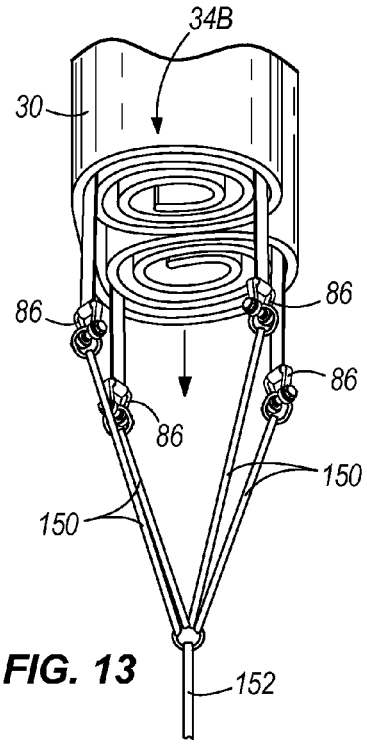
FIG. 13 is a perspective view of a hoist mechanism connected to the inflatable tunnel seal of FIG. 1.

FIG. 11 illustrates a hoist mechanism 138 for use with the inflatable tunnel seal 30. In the illustrated embodiment, the hoist mechanism 138 includes crisscrossing guide ropes 142 and anchor points 146 coupled to the guide ropes 142. As shown in FIG. 12, four primary slings 150 are connected between the anchor points 146 and the shackle arrangements 86 associated with the first end 34A of the tunnel seal 30. Each primary sling 150 is connected to an anchor point 146 positioned above an associated shackle arrangement 86. Two check slings 151 are connected between two of the anchor points 146 and two of the shackle arrangements 86. As shown in FIG. 13, four primary slings 150 are connected between the shackle arrangements 86 associated with the second end 34B of the tunnel seal 34 and a cable 152.

Figure 14:
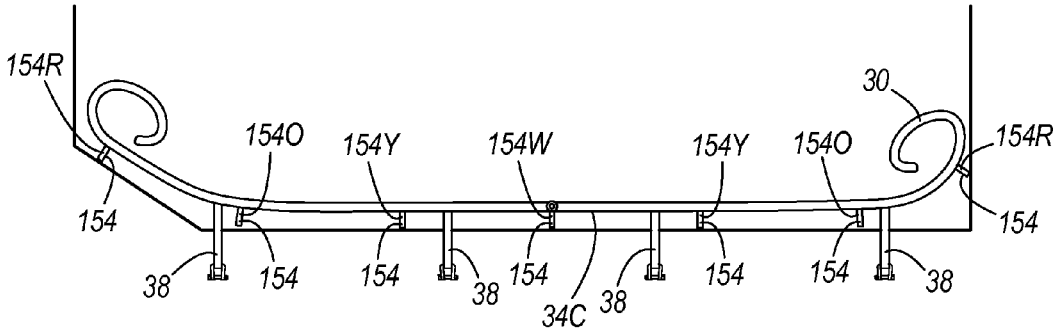
FIG. 14 is an end view of the inflatable tunnel seal of FIG. 1 being unfolded within the mine drift.

FIG. 14 illustrates the inflatable tunnel seal 30 as it is unfolding. The tunnel seal 30 includes markers 154 extending from the lower surface 34C of the body 34 on each end 34A, 34B of the tunnel seal 30 to help properly position the seal 30 within the drift. In the illustrated embodiment, the marker 154W is white, the markers 154Y are yellow, the markers 1540 are orange, and the markers 154R are red. Alternatively, the markers 154 are distinguished from one another by using other indicia, including numbers or shapes.

FIG. 15 illustrates the inflatable tunnel seal 30 being inflated. A supply line 158 extends down the shaft 135 from a fluid source 159 to a vertical receptacle 162. The tunnel seal 30 is positioned in the tunnel 141 below the water table 136. The vertical receptacle 162 includes a guide cone, a check valve, and a delivery hose 166 that directs fluid (e.g., air, water, cement, grout, etc.) from the supply line 158 to the hot stab receptacle 58 to inflate the tunnel seal 30. Alternatively, the delivery hose 166 is connected to one of the inflow ports 42A, 42B.

The inflatable tunnel seal 30 is used to seal off a tunnel 141 filled with water or other liquid. After the inflatable tunnel seal 30 has been inflated, the water can be drained, pumped, or otherwise removed from one side of the seal 30. The tunnel 141 to be sealed can be, for example, a mine drift, a sewer, a utility duct, an aqueduct, or other large or small tunnel. One method of using the tunnel seal 30 is to position the tunnel seal 30 in a tunnel to be sealed, connect a delivery hose 166 to the hot stab receptacle 58, and inflate the tunnel seal 30 with a fluid delivered by the delivery hose 166.

Although the invention has been described in detail with reference to certain preferred embodiments, variations and modifications exist within the scope and spirit of one or more independent aspects of the invention as described.

What is claimed is:

1. A tunnel seal comprising:

a body having a first end and a second end, the body being inflatable from a folded position to an inflated position, the body comprising an inner bladder and an outer cover;

a plurality of positioning straps coupled to the body, at least one of the plurality of straps extending to an end past the first end of the body, the plurality of positioning straps being configured to facilitate hoisting and dragging the body;

an inflow port fluidly connected to the inner bladder;

a pressure relief valve fluidly connected to the inner bladder; and a hot stab receptacle fluidly connected to the inflow port.

2. The tunnel seal of claim 1, wherein the body further comprises:

an intermediate ply positioned between the inner bladder and the outer cover.

3. The tunnel seal of claim 2, the body further comprising:

a second intermediate ply positioned between the intermediate ply and the outer cover; and a plurality of straps positioned between the second intermediate ply and the outer cover.

4. The tunnel seal of claim 1, wherein the outer cover is oversized with respect to the inner bladder such that with the body in an inflated position, the outer cover is at least partially spaced apart from the inner bladder.

5. The tunnel seal of claim 1, further comprising:

a support disc attached to the hot stab receptacle;

wherein with the body in the folded position, the hot stab receptacle extends from the body and the support disc engages an edge of the body.

6. The tunnel seal of claim 1, further comprising:

a strap assembly comprising a plurality of cinch straps wrapped around the body in the folded position; and a release mechanism coupled to the strap assembly, the release mechanism selectively securing the inflatable body in the folded position.

7. The tunnel seal of claim 1, further comprising:

a pad coupled to a lower surface of the body, the pad comprising a plurality of pockets and a plurality of weights positioned inside the plurality of pockets.

8. The tunnel seal of claim 1, further comprising:

a plurality of shackle arrangements, each shackle arrangement being coupled to the end of one of the plurality of positioning straps.

9. The tunnel seal of claim 8, wherein each shackle arrangement includes a web shackle coupled to the end of one of the plurality of positioning straps and a sling link coupled to the web shackle.

* * * * *